US009291055B2

(12) United States Patent
Kim

(10) Patent No.: US 9,291,055 B2
(45) Date of Patent: Mar. 22, 2016

(54) STRUCTURE FOR REDUCING TUNNEL MICRO PRESSURE WAVE INCLUDING AIR PIPE

(71) Applicant: Korea Railroad Research Institute, Uiwang-si, Gyeonggi-do (KR)

(72) Inventor: Dong Hyeon Kim, Seoul (KR)

(73) Assignee: KOREA RAILROAD RESEARCH INSTITUTE, Uiwang-Si (KR)

( * ) Notice: Subject to any disclaimer, the term of this patent is extended or adjusted under 35 U.S.C. 154(b) by 0 days.

(21) Appl. No.: 14/516,684

(22) Filed: Oct. 17, 2014

(65) Prior Publication Data

US 2015/0110561 A1 Apr. 23, 2015

(30) Foreign Application Priority Data

Oct. 21, 2013 (KR) ..... 10-2013-0125215

(51) Int. Cl.
*E21D 9/14* (2006.01)
*B61B 13/10* (2006.01)
*E21F 1/00* (2006.01)

(52) U.S. Cl.
CPC ..... *E21F 1/003* (2013.01); *B61B 13/10* (2013.01); *E21D 9/14* (2013.01)

(58) Field of Classification Search
CPC ..... E21D 9/14; B61B 13/10; E21F 1/003
See application file for complete search history.

(56) References Cited

FOREIGN PATENT DOCUMENTS

| | | | | |
|---|---|---|---|---|
| CN | 201106157 | * | 9/2008 | |
| JP | EP 0515912 | A2 * | 12/1992 | ..... E21D 9/14 |
| JP | 05-163896 | A | 6/1993 | |
| JP | 09-221990 | A | 8/1997 | |
| JP | 2005-155129 | A | 6/2005 | |
| KR | 2001047231 | * | 6/2001 | |
| KR | 10-2009-0042144 | A | 4/2009 | |
| KR | WO 2009057852 | A1 * | 5/2009 | ..... E21D 9/14 |
| KR | 2013063692 | * | 6/2013 | |
| KR | 1394980 | * | 5/2014 | |
| KR | 2014124132 | * | 10/2014 | |

* cited by examiner

*Primary Examiner* — Frederick L Lagman
(74) *Attorney, Agent, or Firm* — Pearne & Gordon LLP

(57) ABSTRACT

A structure for reducing a tunnel micro pressure wave is provided. The structure includes a hood structure formed in front of an entry of a railroad tunnel; and an air pipe section in which at least one air pipe is provided along the circumference of the hood structure, wherein the air pipe comprises a horizontal introduction section formed to be extended from an internal side of the hood structure toward a longitudinal direction of the hood structure, an outlet section formed on an external side of the hood structure, and an intermediate section connecting the horizontal introduction section and the outlet section through each other.

9 Claims, 16 Drawing Sheets

STRUCTURE FOR REDUCING TUNNEL MICRO PRESSURE WAVE INCLUDING AIR PIPE

CROSS-REFERENCE TO RELATED APPLICATION

This application claims the benefit of Korean Patent Application No. 10-2013-0125215 filed on Oct. 21, 2013, the disclosures of which are incorporated herein by reference.

TECHNICAL FIELD

The embodiments described herein pertain generally to a structure for reducing tunnel micro pressure wave including an air pipe.

BACKGROUND

In general, when a railroad car enters into a railroad tunnel, a pressure wave is formed. Such a pressure wave is propagated into the tunnel to be emitted outward in a micro pressure wave form through a tunnel exit. Since the micro pressure wave causes impulsive noise and low frequency vibration to peripheral private houses, it is highly important to reduce the micro pressure wave in designing a railroad tunnel.

Accordingly, for the reduction of the micro pressure wave, a hood having an arch-shaped cross section has been conventionally provided at an entry of a railroad tunnel. Such a hood has been significantly effective in reducing the micro pressure wave.

However, with the recent tendency of increase in the traveling speed of railroad cars and length of railroad tunnels, the tunnel micro pressure wave has been further increased. Accordingly, in order to reduce the micro pressure wave while using the conventional technology that provides a hood at an entry of a railroad tunnel, inner hole cross-sectional area should be widened and a length of the hood should be lengthened. However, there have been found the problems set forth below.

Since a railroad has limit in a roadbed width, and many facilities such as pillars for wiring devices are provided at an entry of a tunnel, there have been significant difficulties in enlarging or lengthening a hood. Further, if a length and an inner hole cross-sectional area of the hood increase, a thickness and hardness, etc., of the hood should also be further increased in order to assure structural stability and others, resulting in increase of construction costs. As a result of these problems, the conventional methods for lengthening a hood or widening a hood inner hole cross-sectional area have had limit in reducing the micro pressure wave.

Further, in recent, there has been a continuous tendency to reduce the tunnel inner hole cross-sectional area in order to reduce construction costs for construction of a 180 km/h or more high speed railroad, and concrete slab tracks have been used, instead of pebble ballast tracks, in order to reduce maintenance and management costs for tracks. However, impulsive noise/vibration by the micro pressure wave of a tunnel exit significantly increases in the small sectional tunnel having slab tracks. Thus, measures to effectively greatly reduce the impulsive noise/vibration are necessary.

SUMMARY

In view of the foregoing problems, example embodiments provide a structure for reducing a tunnel micro pressure wave including an air pipe, which is capable of more effectively reducing the tunnel micro pressure wave.

In accordance with an example embodiment, a structure for reducing a tunnel micro pressure wave is provided. The structure may includes a hood structure formed in front of an entry of a railroad tunnel; and an air pipe section in which at least one air pipe is provided along the circumference of the hood structure, wherein the air pipe comprises a horizontal introduction section formed to be extended from an internal side of the hood structure toward a longitudinal direction of the hood structure, an outlet section formed on an external side of the hood structure, and an intermediate section connecting the horizontal introduction section and the outlet section through each other.

In accordance with the above-described example embodiments, by including a horizontal introduction section to be formed in the same direction as a traveling direction of a railroad car, discharge of a pneumatic pressure can be directly accomplished. Furthermore, since a compressional wave locally going through the air pipe is reflected at an end of the air pipe to be directly transferred as an expansion wave, and thereby, decreasing the compressional wave, tunnel pressure wave (pressure slope) increase can be more effectively delayed. That is, in accordance with the above-described example embodiments, more remarkable performance in reducing a tunnel micro pressure wave (delay of pressure slope increase) can be expected.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1A:
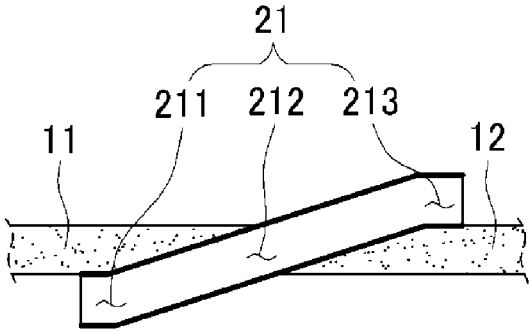
FIGS. 1A, 1B, 1C, 1D, 1E, 1F, 1G and 1H are a schematic conceptual view illustrating various example embodiments of an air pipe in accordance with an example embodiment.
Figure 1B:
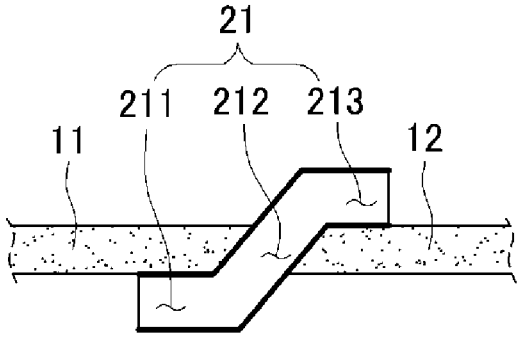
Figure 1C:
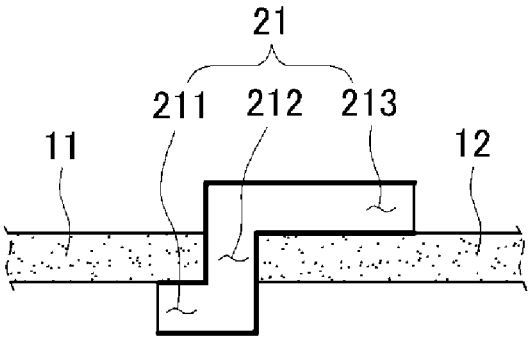
Figure 1D:
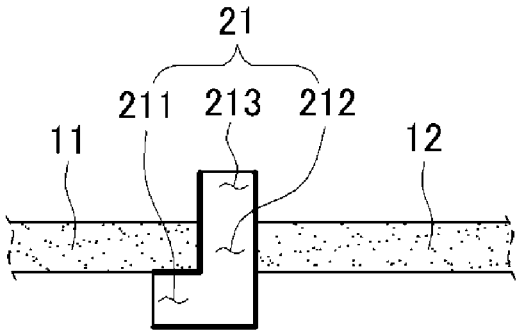
Figure 1E:
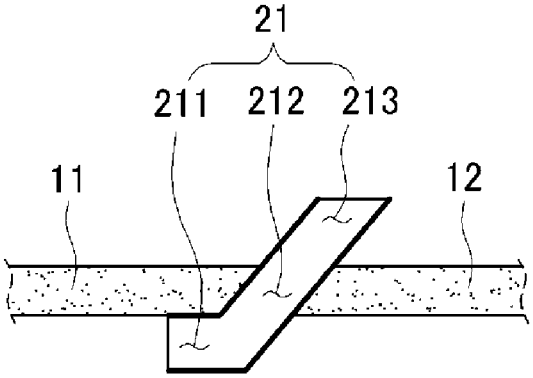
Figure 1F:
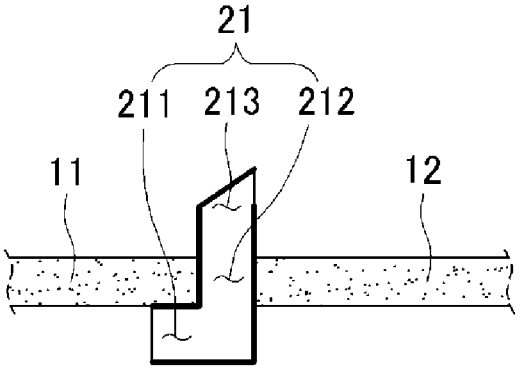
Figure 1G:
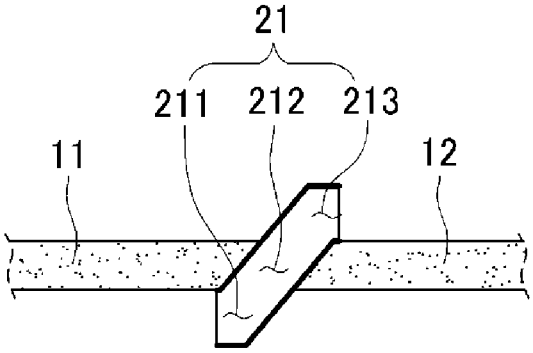
Figure 1H:
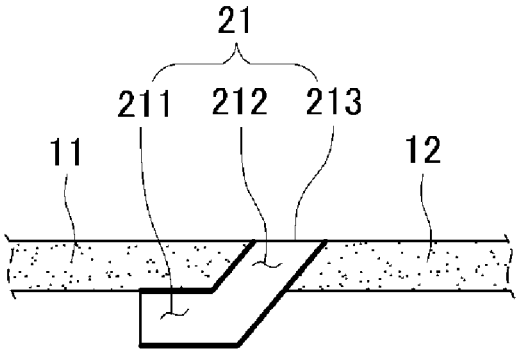

Hereinafter, example embodiments will be described in detail with reference to the accompanying drawings so that inventive concept may be readily implemented by those skilled in the art. However, it is to be noted that the present disclosure is not limited to the example embodiments but can be realized in various other ways. In the drawings, certain parts not directly relevant to the description are omitted to enhance the clarity of the drawings, and like reference numerals denote like parts throughout the whole document.

Throughout the whole document, the terms "connected to" or "coupled to" are used to designate a connection or coupling of one element to another element and include both a case where an element is "directly connected or coupled to" another element and a case where an element is "electronically connected or coupled to" another element via still another element.

Throughout the whole document, the term "on" that is used to designate a position of one element with respect to another element includes both a case that the one element is adjacent to the another element and a case that any other element exists between these two elements.

Throughout the whole document, the term "comprises or includes" and/or "comprising or including" used in the document means that one or more other components, steps, operations, and/or the existence or addition of elements are not excluded in addition to the described components, steps, operations and/or elements. Throughout the whole document, the terms "about or approximately" or "substantially" are intended to have meanings close to numerical values or ranges specified with an allowable error and intended to prevent accurate or absolute numerical values disclosed for understanding of the present invention from being illegally or unfairly used by any unconscionable third party. Throughout the whole document, the term "step of" does not mean "step for."

For reference, in the descriptions of the example embodiments, terms related to directions or positions (forward and backward directions, left and right side portions, an upper side, and a top portion, etc.) have been defined based on the position state of each component shown in the drawings. For example, in FIG. 3 to FIG. 13, the 9 o'clock direction may be substantially a forward direction, the 3 o'clock direction may be substantially a backward direction; in (b) of each of FIG. 3 to FIG. 12, a portion toward the 12 o'clock direction may be substantially a left side portion, and a portion toward the 6 o'clock direction may be substantially a right side portion; in (a) of each of FIG. 3 to FIG. 12, the 12 o'clock direction may be substantially an upper side; and others.

Example embodiments relate to a structure for reducing a tunnel micro pressure wave including an air wave.

Hereinafter, the structure for reducing a tunnel micro pressure wave including an air pipe in accordance with an example embodiment (hereinafter referred to as the "present structure for reducing a tunnel micro pressure wave") will be described.

Figure 2:
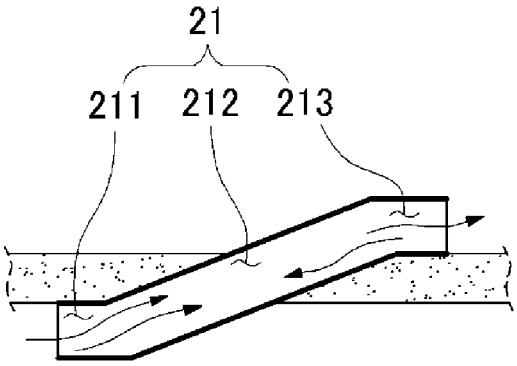
FIG. 2 is a conceptual view for depiction of a function of an air pipe.
Figure 11A:
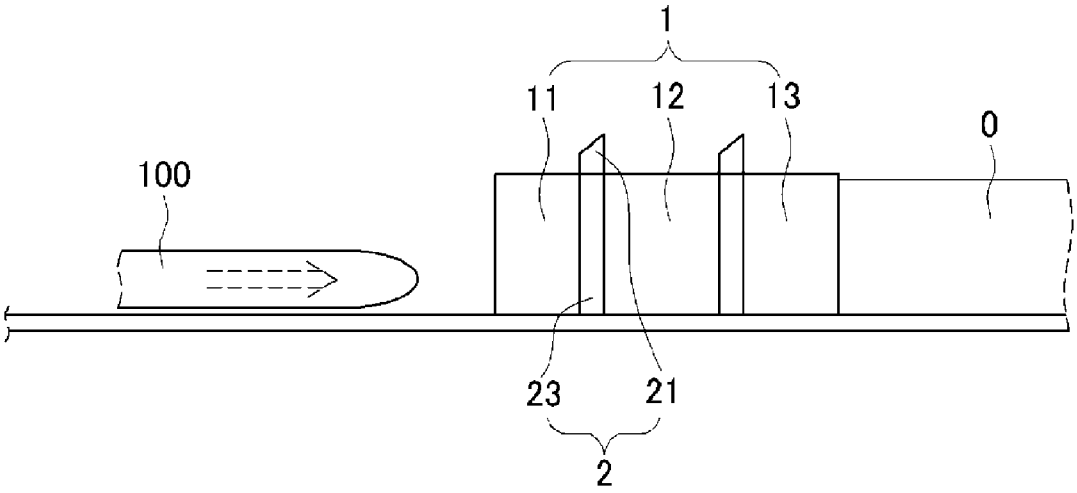
Figure 11B:
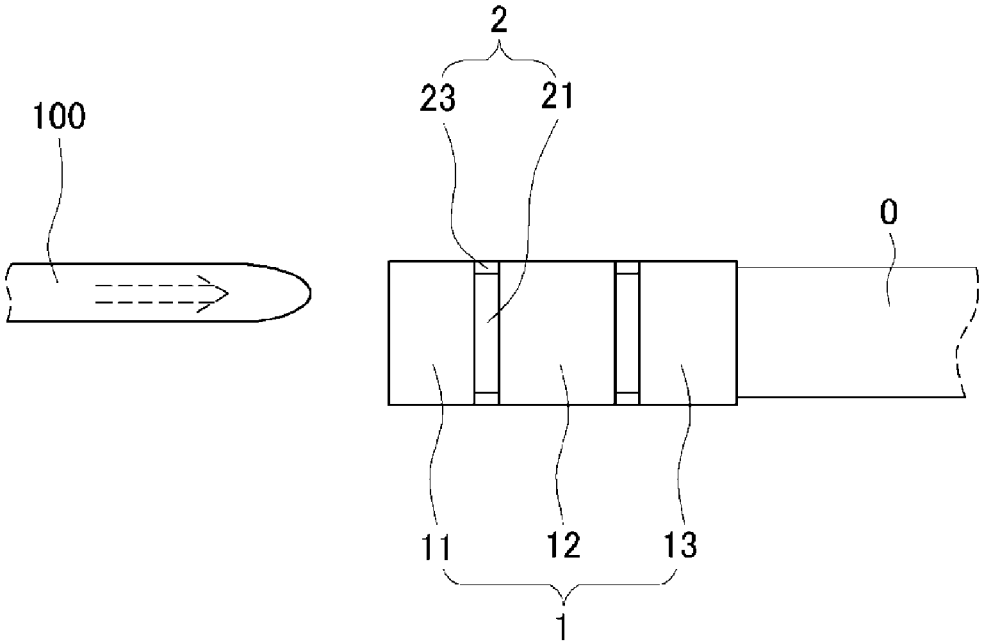
Figure 12A:
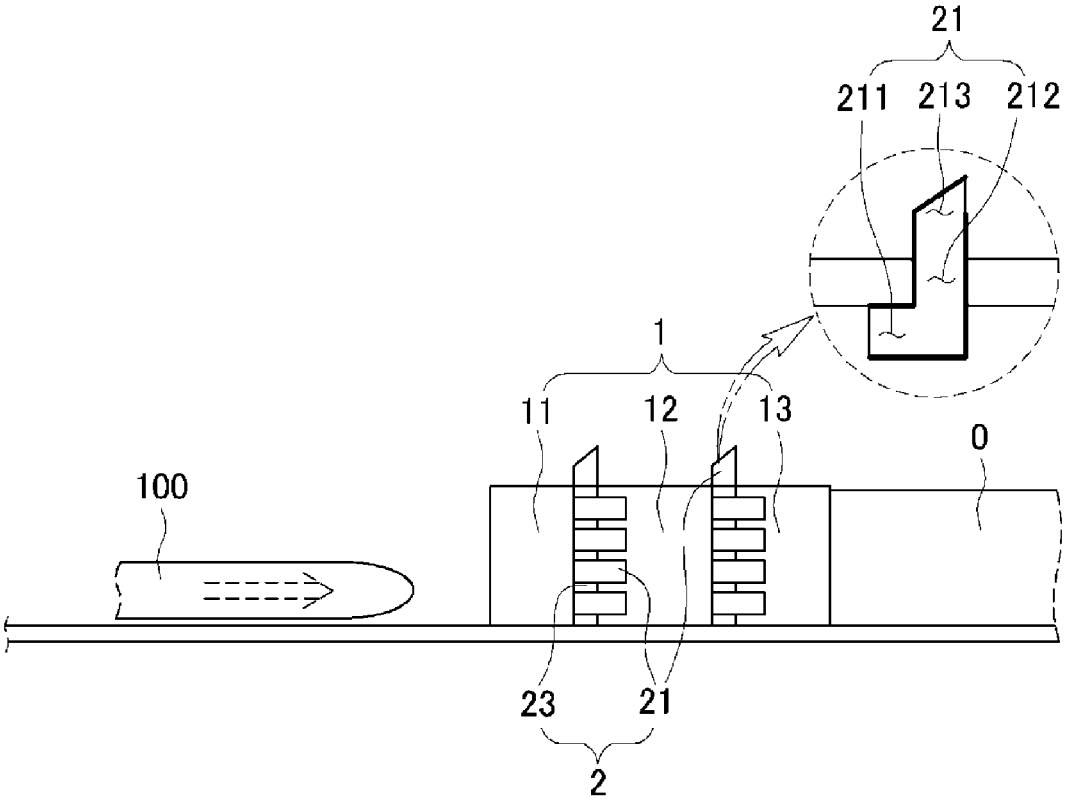
Figure 12B:
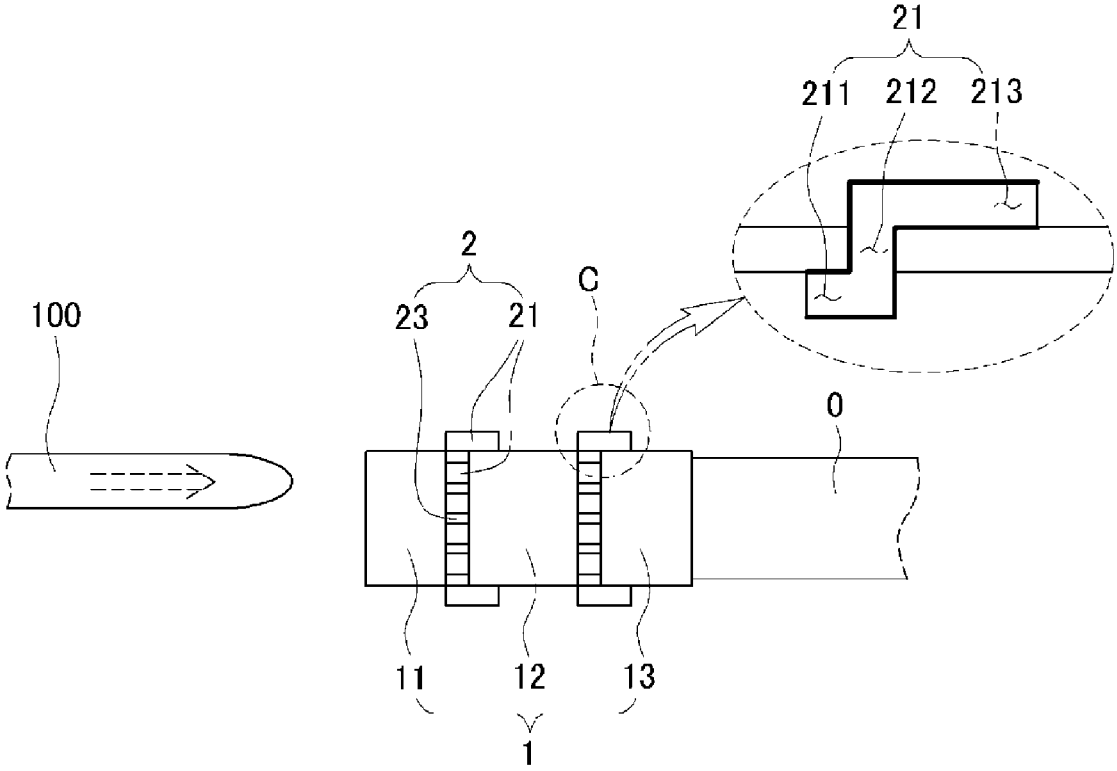
Figure 13A:
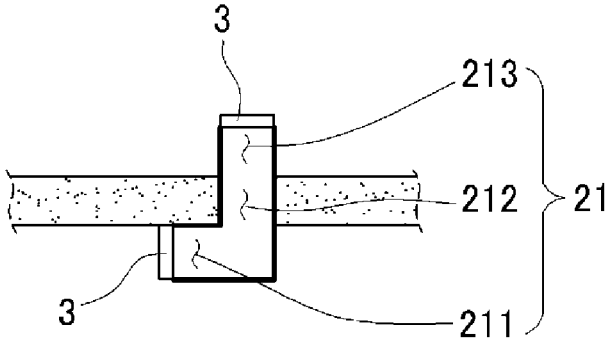
FIGS. 13A, 13B and 13C are a schematic conceptual view for depiction of a cap section provided on an air pipe.
Figure 13B:
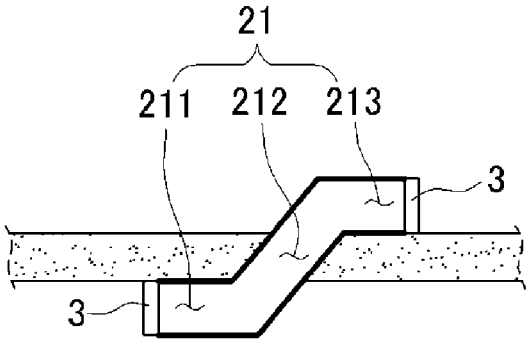
Figure 13C:
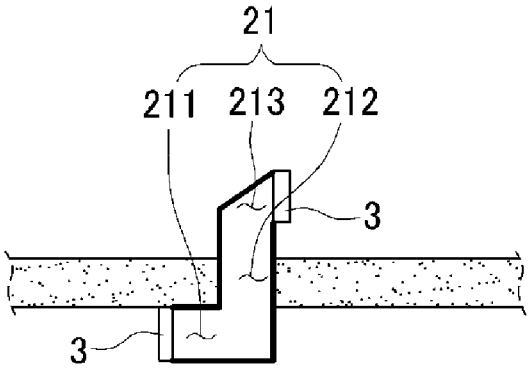

FIG. 1 is a schematic conceptual view illustrating various example embodiments of an air pipe in accordance with an example embodiment, FIG. 2 is a conceptual view for depiction of a function of an air pipe, FIG. 3 to FIG. 12 are conceptual views illustrating various example embodiments of a structure for reducing a tunnel micro pressure wave including an air pipe in accordance with an example embodiment, and FIG. 13 is a schematic conceptual view for depiction of a cap section. In addition, for reference, (a) of each of FIG. 3 to FIG. 12 is a side view when viewed from the right side, and (b) of each of FIG. 3 to FIG. 12 is a plane view.

With reference to FIG. 3 to FIG. 12, the present structure for reducing a tunnel micro pressure wave includes a hood structure 1 and an air pipe section 2.

With reference to FIG. 3 to FIG. 12, the hood structure 1 is formed in front of an entry of a railroad tunnel 0.

The hood structure 1 may be formed with a passageway, through which a railroad car 100 can enter into the entry of the railroad tunnel 0.

In addition, although not illustrated in the drawings, a transversal cross section of the hood structure 1 may be, for example, of polygonal shapes such as a hoof shape, a tetragonal shape and a heptagonal shape, or an arch shape. However, the shape of the transversal cross section of the hood structure 1 is not limited to the above-described shapes, and the transversal cross section of the hood structure 1 may be of various shapes according to construction conditions, necessity for reduction of a tunnel micro pressure wave, and so on.

In addition, with reference to FIG. 3 to FIG. 12, the air pipe section 2 is provided with at least one air pipe 21 along the circumference of the hood structure 1.

In addition, with reference to FIG. 1, the air pipe 21 includes a horizontal introduction section 211, an outlet section 213 and an intermediate section 212.

The present structure for reducing a tunnel micro pressure wave enables a tunnel micro pressure wave to be emitted or a compressional wave pressure slope to be decreased along a path formed by the components of the air pipe 21. Especially, a compressional wave to be developed in a traveling direction of a railroad car is directly introduced for emission through the horizontal introduction section 211 formed to be extended in a longitudinal direction or a pressure slope of a compressional wave can be decreased. Accordingly, the effect in reducing a tunnel micro pressure wave can be maximized.

The configuration related to the present structure for reducing a tunnel micro pressure wave is specifically described below.

The horizontal introduction section 211 of the air pipe 21 is formed while being extended from an internal side of the hood structure 1 toward a longitudinal direction. In general, the horizontal introduction section 211 is horizontally formed, but may be formed to be somewhat diagonal to a horizontal direction depending on slope of a traveling route of a railroad car. Or, the horizontal introduction section 211 may be horizontally formed, irrespective of the slope of the traveling route of a railroad car. In addition, the outlet section 213 is formed on an external side of the hood structure 1, and the intermediate section 212 connects the horizontal introduction section 211 and the outlet section 213 through each other.

In addition, the direction of the horizontal introduction section 211, which is formed while being extended from an internal side of the hood structure 1 toward a longitudinal direction (forward and backward direction), may be parallel with the traveling direction of the railroad car 100 passing through the hood structure 1. In general, since a compressional wave formed by the railroad car 100 passing through the hood structure 1 is developed (moves) in parallel with the traveling direction of the railroad car 100, the compressional wave can be directly introduced into the horizontal introduction section 211. Accordingly, effective reduction of compressional wave pressure slope and a tunnel micro pressure wave can be realized. For reference, with reference to FIG. 1 and FIG. 2, based on the multiple hoods 11, 12, the 6 o'clock direction corresponds to the internal side of the hood structure 1, and the 12 o'clock direction corresponds to the external side of the hood structure 1.

In addition, with reference to FIG. 1, the intermediate section 212 may be a portion formed passing through the hood structure 1.

For example, if the hood structure 1 is provided with one hood, the intermediate section 212 may be formed passing through the wall of the hood structure 1.

Or, although will be described later, as illustrated in FIG. 3 to FIG. 12, if the hood structure 1 is a structure divided into a multiple number of hoods 11, 12, 13, and the air pipe sections 2 are formed between the hoods 11, 12 and between the hoods 12, 13, respectively, with reference to FIG. 1, the intermediate section 212 may be formed to be interposed between the hoods 11, 12 and between the hoods 12, 13, to pass through the hood structure 1. For reference, FIG. 1 illustrates various example embodiments of the air pipe 21 of the air pipe section 2 formed between the first hood 11 and the second hood 12 of the multiple hoods 11, 12, 13.

In addition, with reference to (c), (d) and (f) of FIG. 1, the intermediate section 212 may be formed to be perpendicular to the wall of the hood structure 1. Or, with reference to (a), (b), (e), (g) and (h) of FIG. 1, the intermediate section 212 may be formed to be diagonal to the wall of the hood structure 1.

Figure 4A:
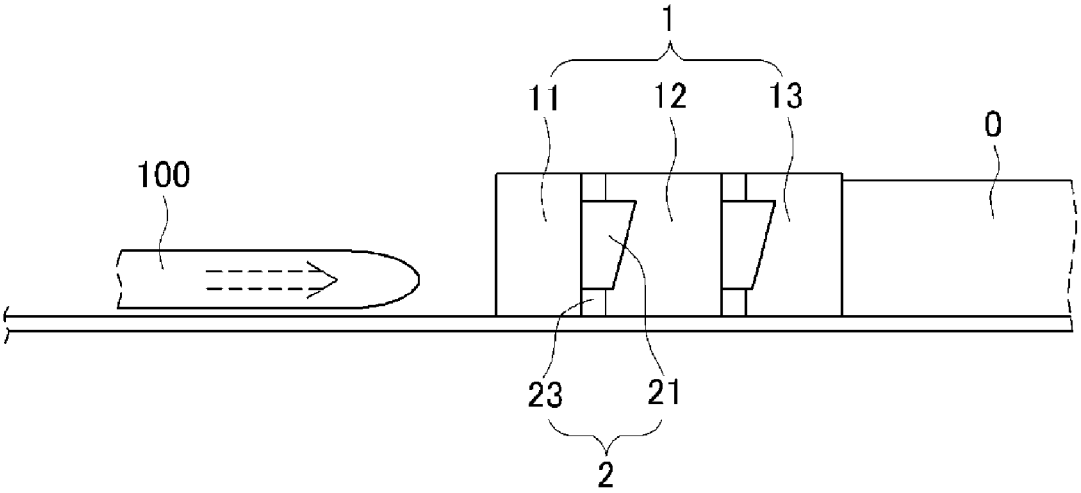
Figure 4B:
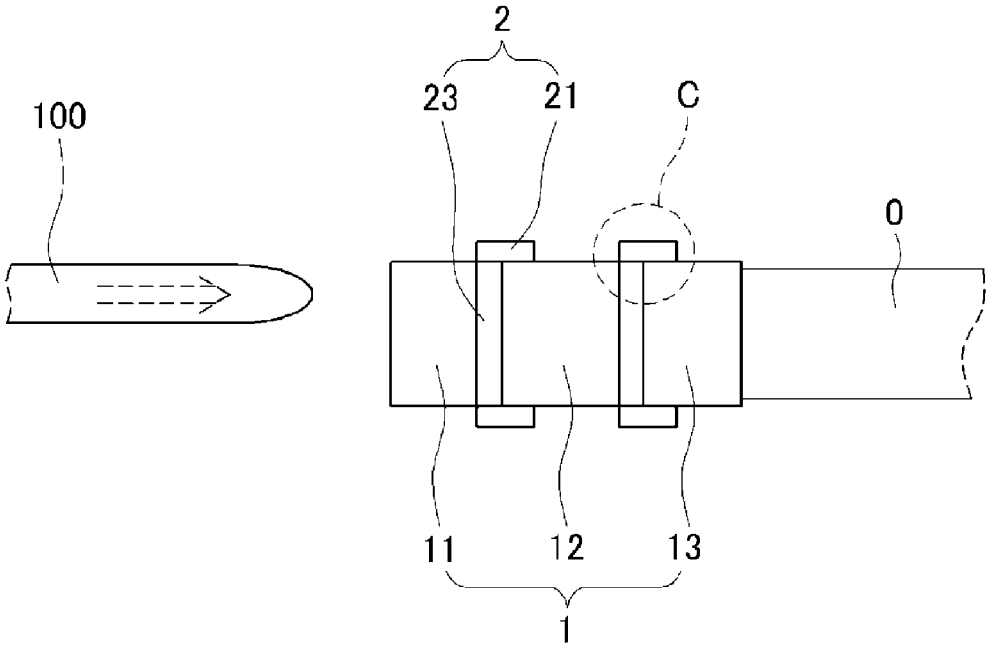

For example, in case of the intermediate section 212 formed to be diagonal to the wall of the hood structure 1, as illustrated in (a), (b), (e), (g) and (h) of FIG. 1, an angle (an angle formed substantially in the 4 o'clock direction with reference to FIG. 4) formed by the direction, toward which the intermediate section 212 is formed, and the direction (longitudinal direction), toward which the hood structure 1 is formed, is an acute angle.

In addition, with reference to (d), (e) and (f) of FIG. 1, the outlet section 213 may be formed to be extended from the intermediate section 212 toward the same direction as the direction, toward which the intermediate section 212 is extended.

Or, with reference to (a), (b), (c) and (g) of FIG. 1, the outlet section 213 may be formed to be bent and extended from the intermediate section 212 toward a backward direction.

For example, as illustrated in (a), (b) and (g) of FIG. 1, the outlet section 213 may be bent and extended from the intermediate section 212, which is formed to be diagonally extended, toward the backward direction. With respect to another example, as illustrated in (c) of FIG. 1, the outlet section 213 may be orthogonally bent and extended from the intermediate section 212, which is formed to be perpendicularly extended to the wall of the hood structure 1, toward the backward direction.

Or, as illustrated in (h) of FIG. 1, the outlet section 213 may be a hole formed on an external surface of the hood structure 1.

That is, in example embodiments, the configuration that the outlet section 213 is formed on the external side of the hood structure 1 includes not only the configuration that the outlet section 213 is extended from the intermediate section 213 to be protruded from the external surface of the hood structure 1, as illustrated in (a) to (g) of FIG. 1, but also the configuration that the outlet section 213 is formed in the shape of a hole on the external surface of the hood structure 1, as illustrated in (h) of FIG. 1.

In addition, with reference to FIG. 2, the horizontal introduction section 211, the outlet section 213 and the intermediate section 212 may form a flow path. The flow path is capable of reflecting at least part of a compressional wave passing through the flow path as an expansion wave.

For example, with reference to FIG. 2, part of a compressional wave, which is introduced into the horizontal introduction section 211 to be transferred to the intermediate section 212 and the outlet section 213, may be reflected in the form of an expansion wave at the outlet section 213.

That is, as illustrated in FIG. 2, the air pipe 21 may emit a compressional wave, and furthermore, serve as a compressional wave reflection duct, which results in offset or decrease of a compressional wave within the hood structure by returning part of a compressional wave propagated into the air pipe 21. For reference, FIG. 2 is a conceptual view using the air pipe illustrated in (a) of FIG. 1 for depiction of the function of the air pipe 2.

In addition, the outlet section 213 may be of the shape that can most effectively reduce a tunnel micro pressure wave. For example, the shape of the outlet section 213 may be designed and formed to maximize the effect of reduction of a tunnel micro pressure wave (maximize emission of a compressional wave and offset or decrease of a compressional wave) in consideration of a size of the hood structure 1, a size of the railroad tunnel 0, a speed of the railroad car 100 passing through the tunnel.

For example, with reference to (a) to (c), (f) and (g) of FIG. 1, the end of the outlet section 213 may be of a shape opened toward the backward direction, or with reference to (d) and (e) of FIG. 1, the end of the outlet section 213 may be of a shape opened toward the upper side. In addition, the air pipe 21 may be provided in at least one of a left side portion, a right side portion and an upper portion of the air pipe section 2.

In addition, the outlet section 213 may be formed in various shapes in a design aspect. For example, the outlet section 213 may be formed in the shape that the end of the outlet section 213 has a tail part being extended to traverse the upward and downward direction, like the uppermost one of the air pipes 21 illustrated in (a) of FIG. 9.

In addition, for example, as illustrated in FIG. 3 to FIG. 10 and FIG. 12, the air pipe 21 may be provided in each of the left and right side portions of the air pipe section 2. In addition, as illustrated in FIG. 11, the air pipe 21 may be provided at the top portion of the air pipe section 2. In addition, as illustrated in FIG. 12, the air pipe 21 may be provided in each of the left and right side portions and the top portion of the air pipe section 2.

In addition, if the air pipe 21 is provided on the top portion of the air pipe section 2, with reference to (a) of FIG. 12, the outlet section 213 of the air pipe 21 may be extended in the same direction as the direction, toward which the intermediate section 212 is extended, and the end of the outlet section 213 may be of a shape opened toward the backward direction [refer to (f) of FIG. 1].

Figure 3A:
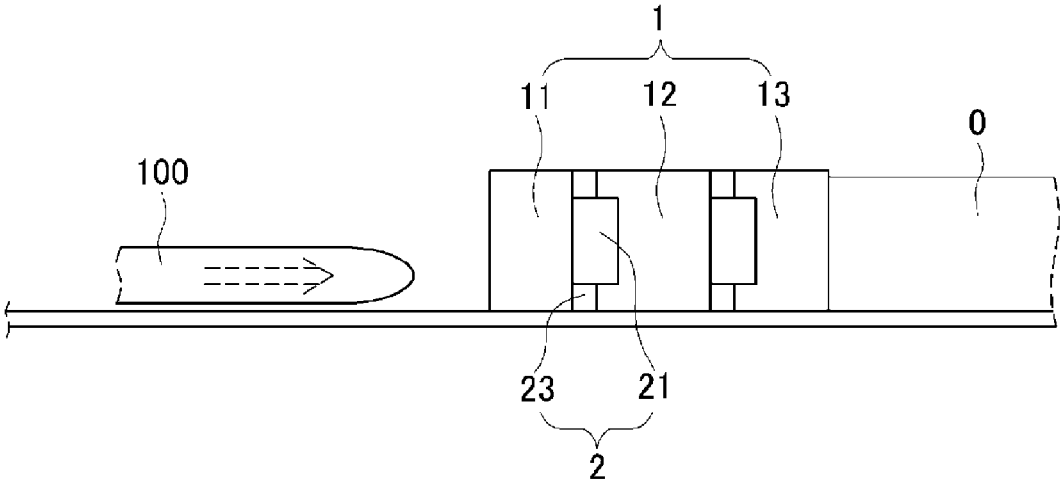
FIG. 3A, 3B, 4A, 4B, 5A, 5B, 6A, 6B, 7A, 7B, 8A, 8B, 9A, 9B, 10A, 10B, 11A, 11B, 12A, 12B are conceptual views illustrating side and plane views of various example embodiments of a structure for reducing a tunnel micro pressure wave including an air pipe in accordance with an example embodiment.
Figure 3B:
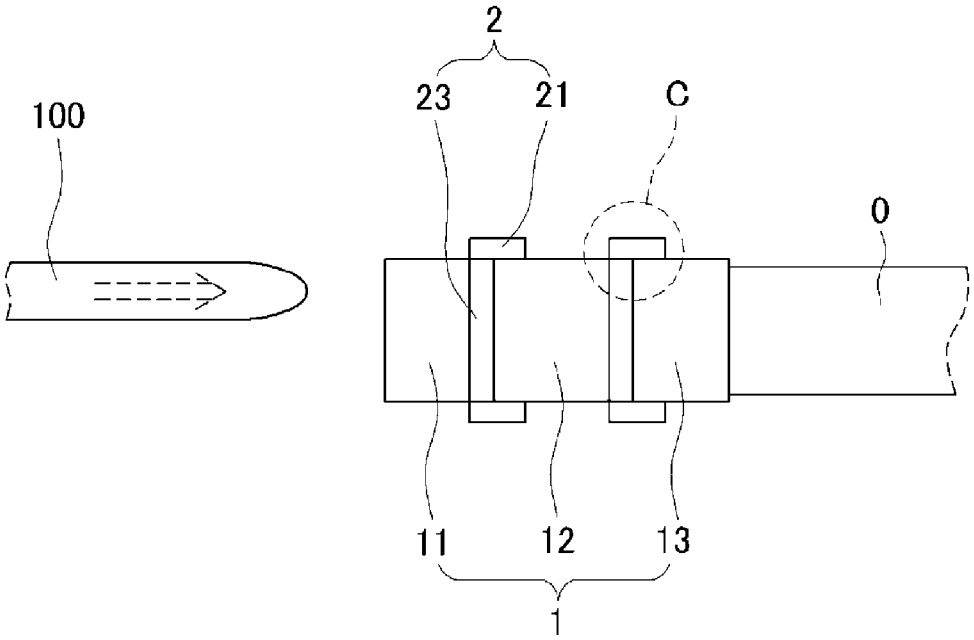
Figure 5A:
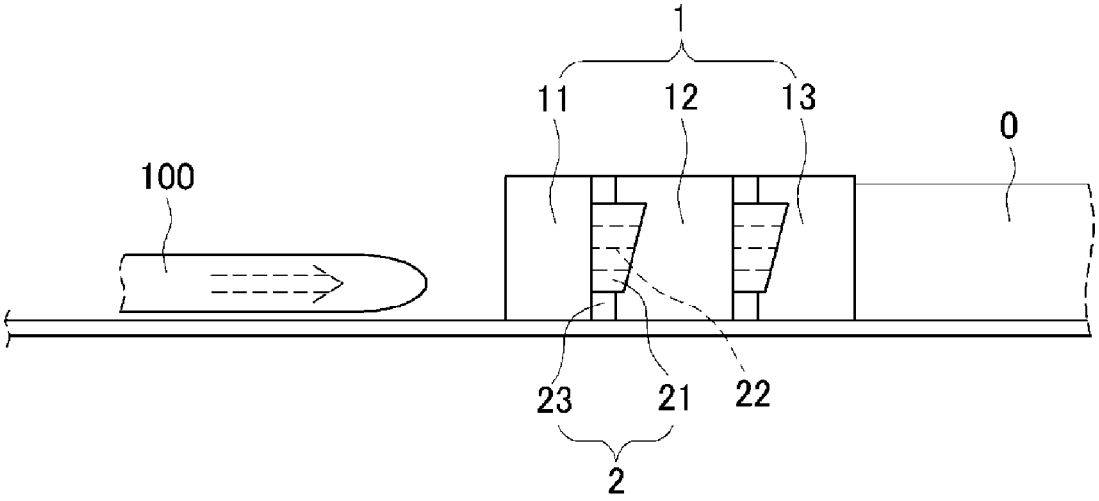
Figure 5B:
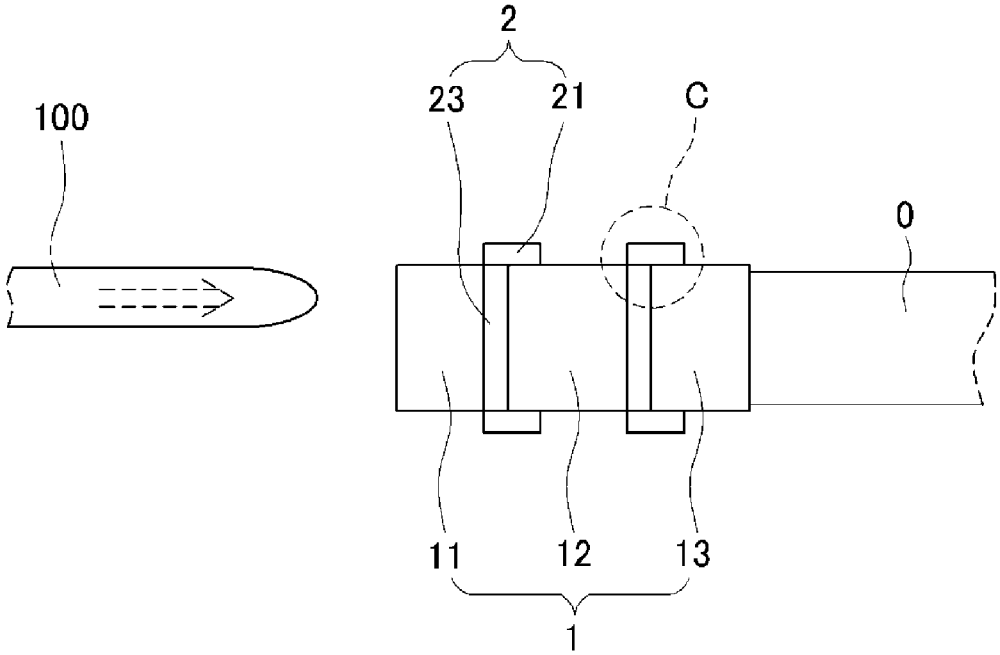

In addition, with reference to (a) and (b) of FIG. 3 to FIG. 5 together, one air pipe 21 may be provided in each of left and right side portions. For reference, a longitudinal cross section of c of each of FIG. 3 to FIG. 5 may be, for example, (a) of FIG. 1. In addition, although will be described later, a filling section 23 may be formed in the remaining area of the circumference of the hood structure 1 where the air pipes 21 are not formed, as illustrated in the drawing.

In addition, with reference to FIG. 5, one air pipe 21 provided in each of the left and right side portions may include partition sections 22 simultaneously partitioning the horizontal introduction section 211, the outlet section 213 and the intermediate section 212. Accordingly, each of the air pipes 21 may be formed with a multiple number of flow paths.

For example, when comparing FIG. 5 with FIG. 4, a multiple number of flow paths may be formed by applying partition sections 22 forming partition walls along the longitudinal direction to the air pipe 21 forming one flow path.

In addition, as another example embodiment, with reference to (a) and (b) of each of FIG. 6 to FIG. 10 together, the air pipe 21 may be formed in multiple numbers in each of the left and right side portions.

Figure 6A:
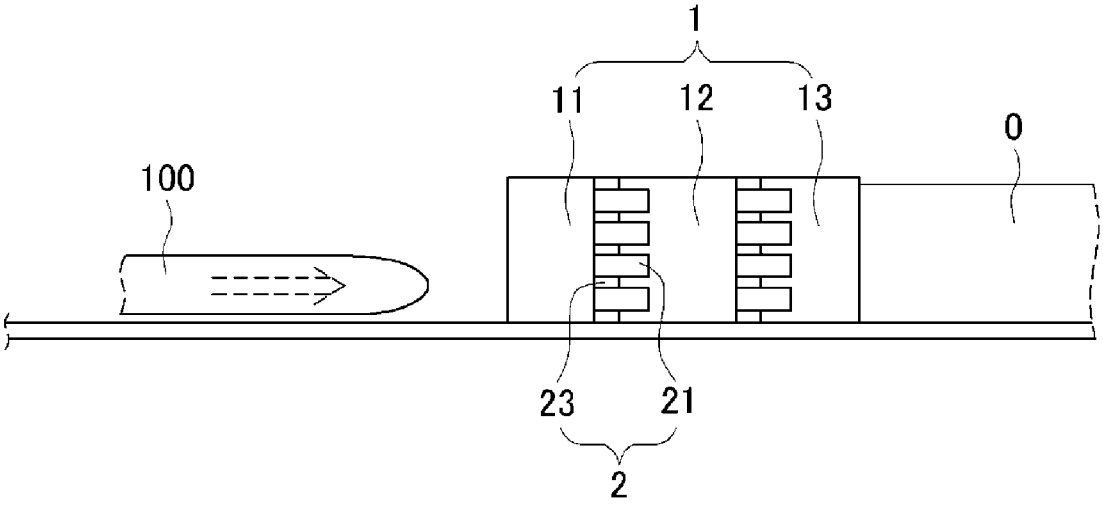
Figure 6B:
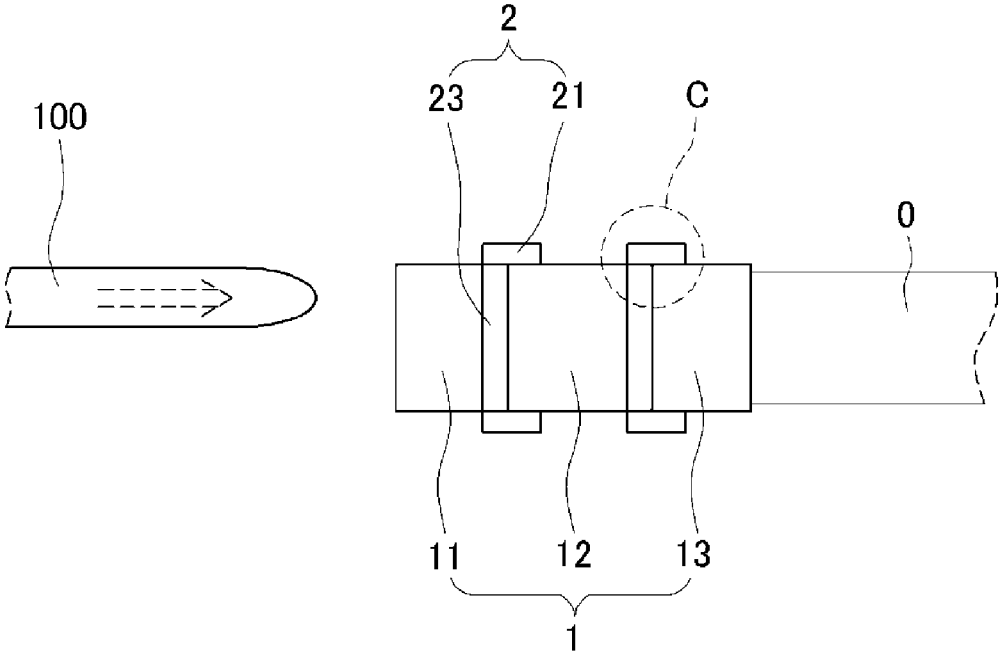
Figure 7A:
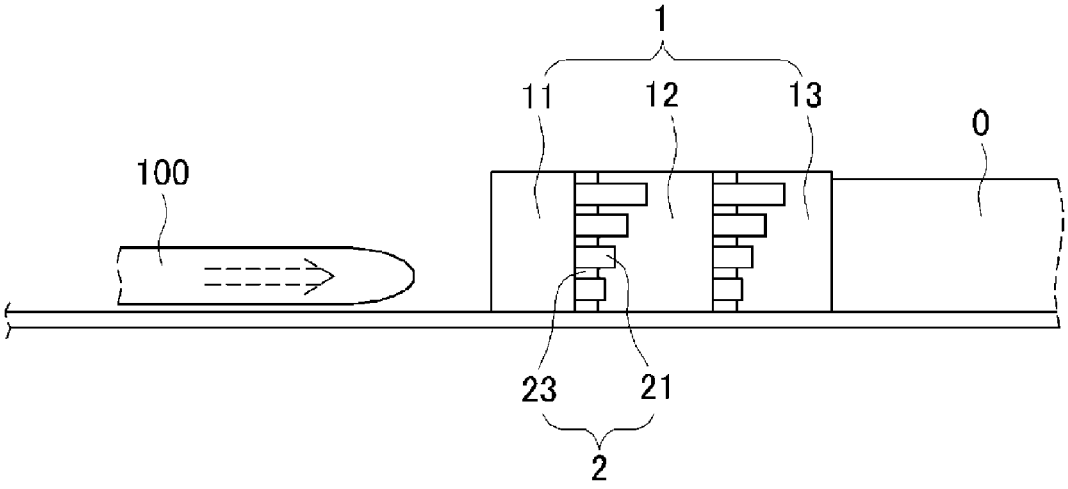
Figure 7B:
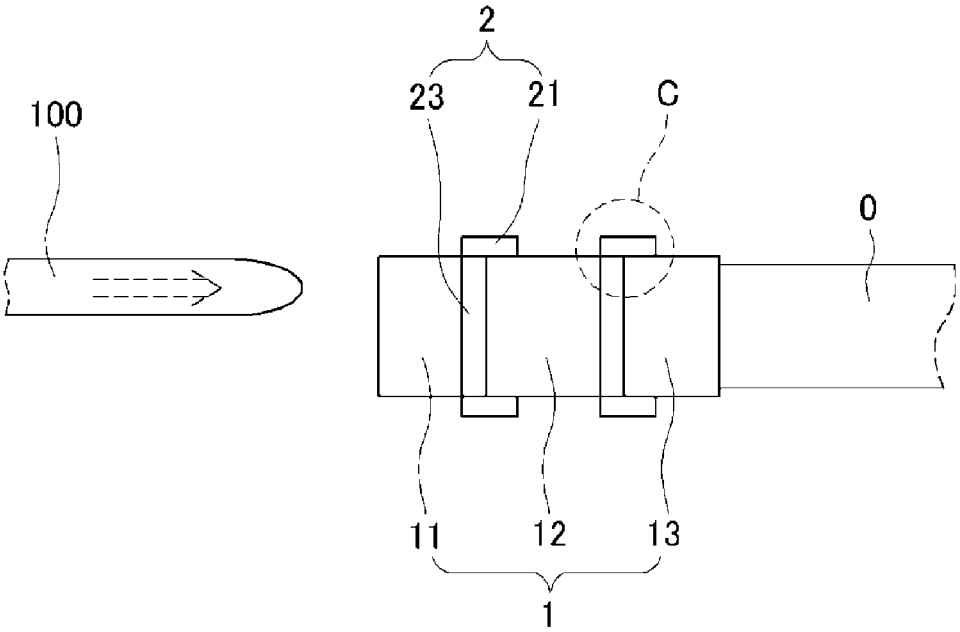
Figure 8A:
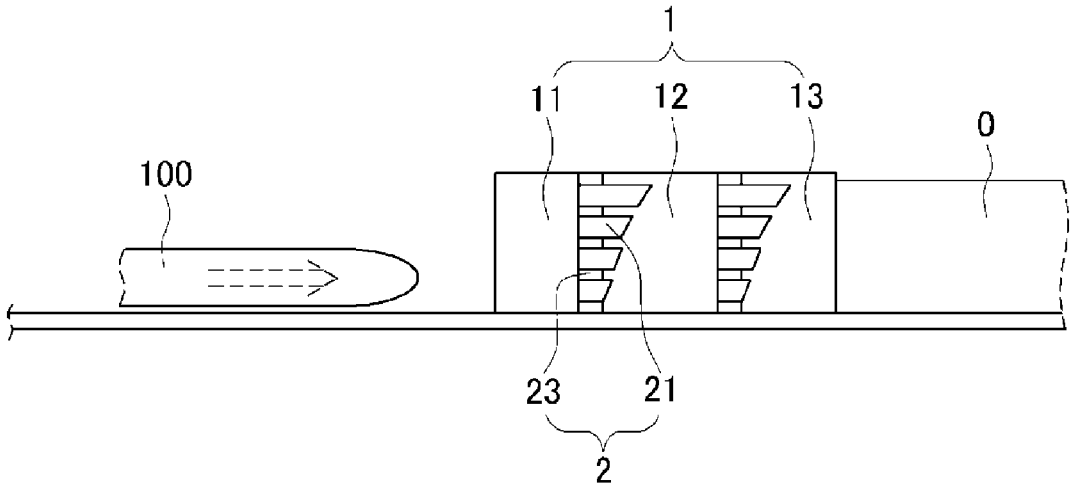
Figure 8B:
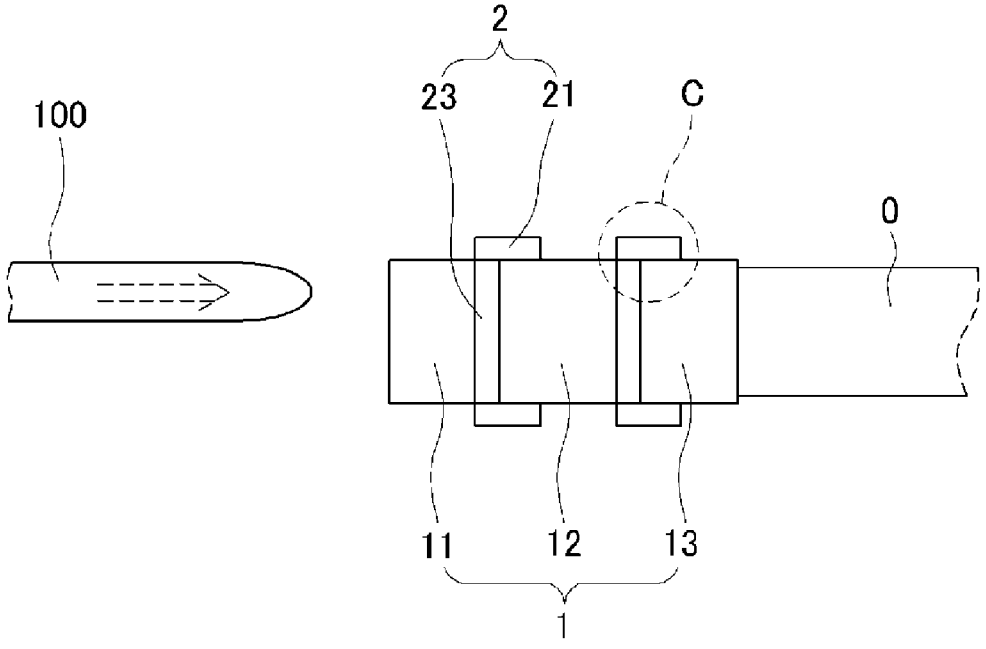
Figure 9A:
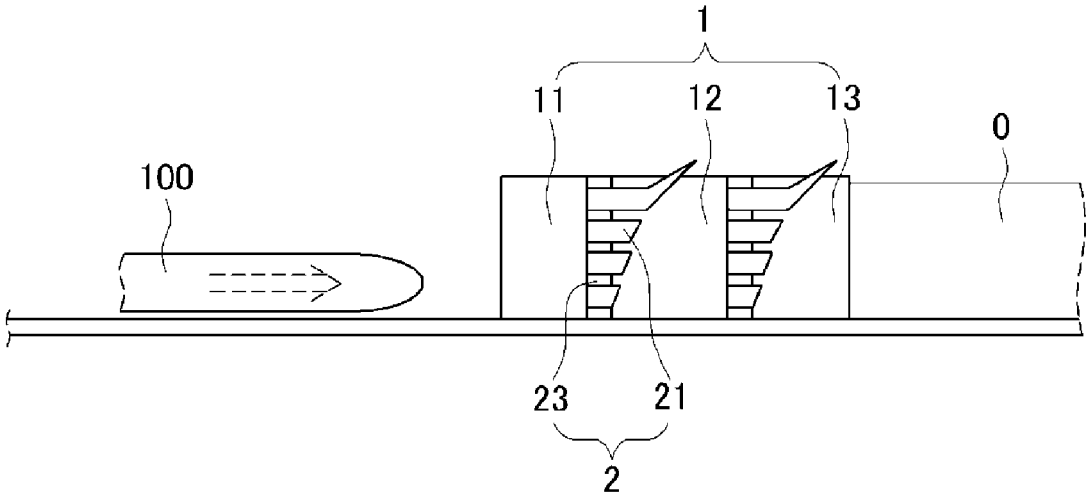
Figure 9B:
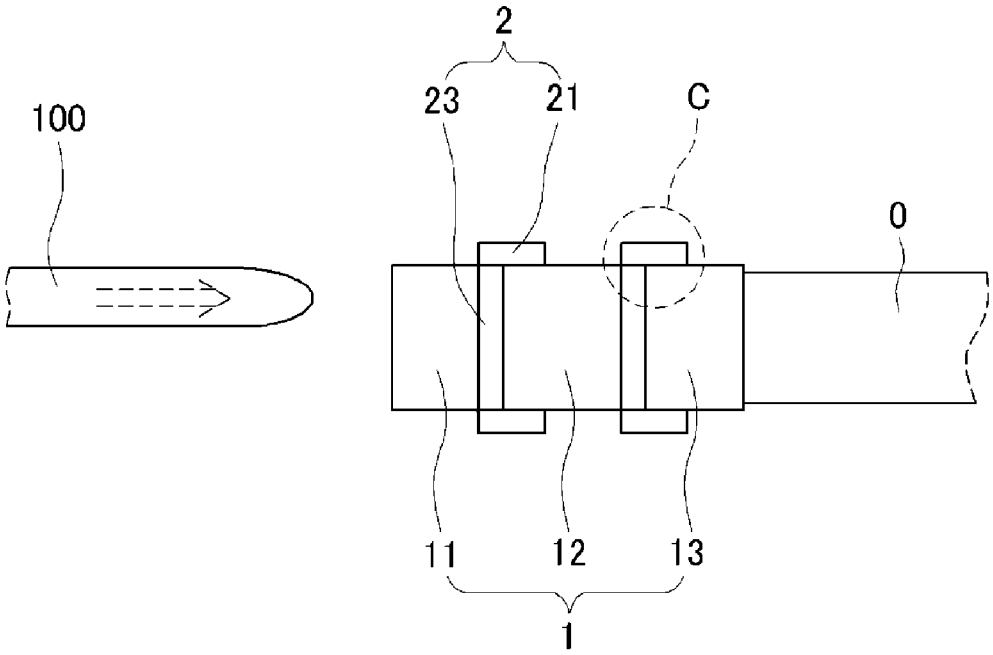
Figure 10A:
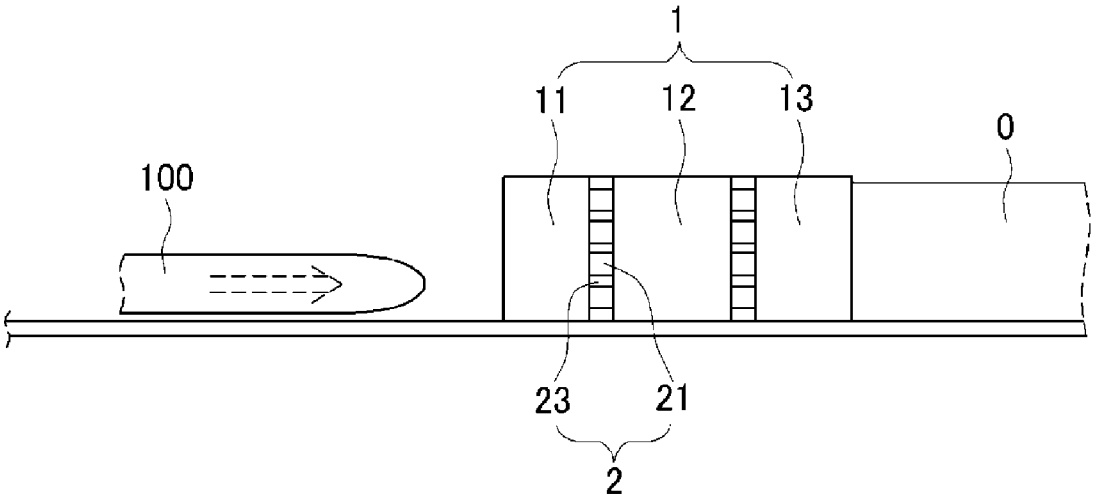
Figure 10B:
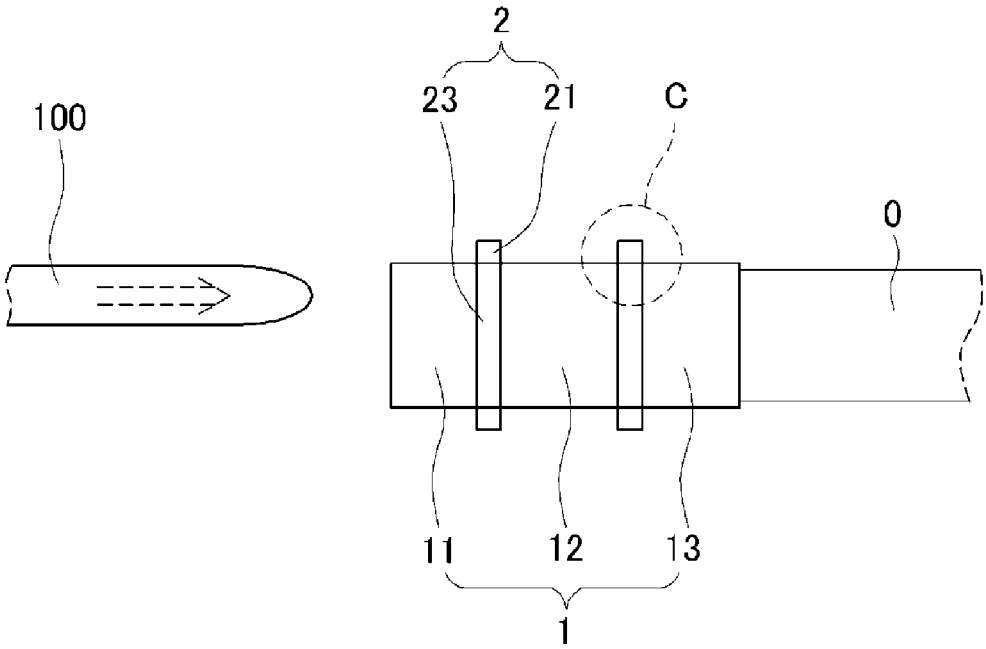

For reference, the longitudinal cross section of c of FIG. 6 may be, for example, (b) of FIG. 1. In addition, the longitudinal cross section of c of each of FIG. 7 to FIG. 9 may be, for example, one of (b), (c), and (g) of FIG. 1. In addition, the longitudinal cross section of c of FIG. 10 may be, for example, (d) or (e) of FIG. 1.

In addition, if the air pipe 21 is provided in multiple numbers in each of the left and right side portions, longitudinal lengths of the multiple number of the air pipes 21 may be identical to one another, as illustrated in (a) of FIG. 6. Or, the longitudinal lengths of the multiple number of the air pipes 21 may be different from one another, as illustrated in (a) of each of FIG. 7 to FIG. 9. For example, as illustrated in (a) of each of FIG. 7 to FIG. 9, the longitudinal lengths of the multiple number of the air pipes 21 may increase as their positions are close to the upper side, compared to the longitudinal lengths of the air pipes 21 close to the lower side. Or, as illustrated in FIG. 3 and FIG. 12, the longitudinal lengths of the air pipes 21 may be constant, when viewed from the side surface.

Or, as illustrated in (a) of each of FIG. 4, FIG. 5, FIG. 8 and FIG. 9, a length of an upper end of one air pipe 21 may be longer than a length of a lower end thereof, when viewed from the side surface.

Or, as illustrated in (b) of FIG. 11 and (b) of FIG. 12, the air pipe 21 may be provided in the top portion.

In this case, as illustrated in (b) of FIG. 11, one air pipe 21 may be provided on the top portion of the air pipe section 2. Or, as illustrated in (b) of FIG. 12, the air pipes 21 may be provided in multiple numbers on the top portion of the air pipe section 2 along the transverse direction.

As described above, the air pipe 21 provided in the top portion may be of the same shape as illustrated in (f) of FIG. 1.

In addition, with reference to FIG. 13, the present structure for reducing a tunnel micro pressure wave may include a cap section 3, which is capable of selectively closing the rear end of the outlet section 213. In other words, the cap section 3 may close the rear end of the flow path.

For example, (a) of FIG. 13 illustrates that the air pipe 21 illustrated in (d) of FIG. 1 is provided with the cap section 3, (b) of FIG. 13 illustrates that the air pipe 21 illustrated in (b) of FIG. 1 is provided with the cap section 3, and (c) of FIG. 13 illustrates that the air pipe 21 illustrated in (f) of FIG. 1 is provided with the cap section 3.

In addition, the cap section 3 may be detachable. Accordingly, tuning the air pipe section 2 is possible. For example, the air pipe section may be tuned, by closing at least one of the opened air pipes 21 with the cap section 3, or opening at least one of the closed air pipes 21. Accordingly, the effect in reducing a tunnel micro pressure wave can be further improved.

For example, if tuning the air pipe section 2 is necessary for reduction of a micro pressure wave due to change in conditions and environments such as increase in speed of the railroad car 100, at least one of the air pipes 21 may be closed with the cap section 3, or the closed air pipes 21 may be opened, such that the effect in reducing a tunnel micro pressure wave can be maintained or improved even in case of the change in environments.

In addition, the air pipe section 2 may be provided in multiple numbers along the longitudinal direction with intervals.

For example, FIG. 3 to FIG. 12 illustrate the present structure for reducing a tunnel micro pressure wave, wherein two (2) air pipe sections 2 are provided along the longitudinal direction with intervals.

Meanwhile, the hood structure 1 may be formed to be divided into a multiple number of portions along the longitudinal direction. For example, with reference to FIG. 3 to FIG. 12, the hood structure 1 may include a multiple number of hoods 11, 12, 13 arranged while being spaced with gaps along the longitudinal direction.

The multiple hoods 11, 12, 13 may form a passageway, through which the railroad car 100 can enter into the entry of the railroad tunnel 0.

In addition, as illustrated in FIG. 3 to FIG. 12, the hood structure 1 may be provided with three (3) hoods 11, 12, 13, but not limited thereto. For example, the multiple hoods may be two, three, or more, unlike the drawings. The specific number of the hoods is preferably set in the direction, toward which the air pipe section 2 is provided, so as to maximize the effect in reducing a tunnel micro pressure wave.

If the hood structure 1 is provided with the multiple hoods 11, 12, 13, the air pipe section 2 may be formed in the gap. In addition, the air pipe section 2 may include a filling section 23, which is formed in the portion of the gap where the air pipe 21 is not provided. That is, the filling section 23 is capable of closing the remaining area of the gap where the air pipe 21 is not provided, in order to enable a compressional wave to be emitted through the air pipe 21.

The filling section 23 may include, for example, cement, sand, a steel plate, and others.

In addition, as another example embodiment of the hood structure 1, the hood structure 1 may not be divided into a multiple number of hoods, and may be provided with one hood. In this case, the air pipe section 2 may be provided such that each of the air pipes 21 is arranged to pass through the wall of the hood structure 1. In addition, for the arrangement of the air pipes 21, for example, a window where the air pipes 21 can be provided may be prepared in advance when constructing the hood structure 1.

In addition, the air pipe section 2 may include a pipe (not illustrated in the drawings) for fixing the air pipes 21. When the air pipe section 2 includes a multiple number of the air pipes 21, the pipe is capable of connecting the multiple number of the air pipes 21 to one another.

In addition, the pipe may be provided in the internal side of the air pipe section 2. In this case, for example, the pipe may be provided along the inner circumference of the air pipe section 2.

For example, as illustrated in FIG. 6 to FIG. 10, when the air pipe 21 is provided in multiple numbers in each of the left and right side portions of the air pipe section 2, one pipe may be provided in each of the left and right sides of the internal side of the air pipe section 2. In this case, each of the pipes provided in the left and right sides may be provided from the top portion of the air pipe section 2 toward the ground along the inner circumference of the air pipe section 2. In addition, the pipe provided in the left side may connect the multiple number of the air pipes 21 provided in the left side portion to one another. Likewise, the pipe provided in the right side may connect the multiple number of the air pipes 21 provided in the right side portion to one another.

In addition, the pipes may be provided on the external side of the air pipe section 2. In this case, the pipes may be provided along the outer circumference of the air pipe section 2.

In addition, the air pipe section 2 may include a pillar (not illustrated in the drawings) for fixing the air pipes 21. The fixing pillar may be provided on the external side of the air pipe section 2. In addition, if the air pipe section 2 includes the multiple number of the air pipes 21, the fixing pillar may connect the multiple number of the air pipes 21 to one another.

For example, as illustrated in FIG. 6 to FIG. 10, when the air pipe 21 is provided in multiple numbers in each of the left and right side portions of the air pipe section 2, one fixing pillar may be provided in each of the left and right sides of the internal side of the air pipe section 2. A cross section of the fixing pillar may be, for example, tetragonal.

The above description of the example embodiments is provided for the purpose of illustration, and it would be understood by those skilled in the art that various changes and modifications may be made without changing technical conception and essential features of the example embodiments. Thus, it is clear that the above-described example embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the example embodiments. It shall be understood that all modifications and embodiments conceived from the meaning and scope of the claims and their equivalents are included in the scope of the inventive concept.

EXPLANATION OF CODES

1: hood structure
11, 12, 13: a multiple number of hoods
2: air pipe section
21: air pipe
211: horizontal introduction section
212: intermediate section
213: outlet section
23: filling section
3: cap section
0: railroad tunnel
100: railroad car

I claim:

1. A micro pressure wave reduction structure for a tunnel, comprising:

a hood structure formed in front of an entry of a railroad tunnel; and an air pipe section in which at least one air pipe is provided along circumference of the hood structure, wherein the air pipe comprises a horizontal introduction section formed to be extended from an internal side of the hood structure toward a longitudinal direction of the hood structure, an outlet section formed on an external side of the hood structure, and an intermediate section connecting the horizontal introduction section and the outlet section through each other, the air pipe section comprises a plurality of air pipes provided at intervals along the longitudinal direction of the hood structure, and the hood structure comprises a plurality of hoods, which are divided and arranged to be spaced with a gap along the longitudinal direction and the air pipe section further comprises a filling section formed in the gap to close a remaining area of the gap where no air pipe is provided.

2. The micro pressure wave reduction structure for a tunnel of claim 1, wherein the horizontal introduction section, the outlet section and the intermediate section form a flow path, which reflects at least part of a compressional wave passing through the sections as an expansion wave.

3. The micro pressure wave reduction structure for a tunnel of claim 1, wherein the outlet section comprises an air pipe, which is extended in the same direction as the direction, toward the intermediate section is extended, or bent and extended in a backward direction.

4. The micro pressure wave reduction structure for a tunnel of claim 3, wherein the outlet section comprises an air pipe, of which end is opened toward an upper side or a backward direction.

5. The micro pressure wave reduction structure for a tunnel of claim 1, wherein the air pipe is an air pipe provided in at least one position of a left side portion, a right side portion, and a top portion of the air pipe section.

6. The micro pressure wave reduction structure for a tunnel of claim 5, wherein if the air pipe is provided on the top portion of the air pipe section, the outlet section is extended in the same direction as the direction, toward which the intermediate section is extended, and the end of the outlet section is opened toward a backward direction.

7. The micro pressure wave reduction structure for a tunnel of claim 1, wherein the intermediate section is perpendicular or diagonal to a wall of the hood structure.

8. The micro pressure wave reduction structure for a tunnel of claim 1, wherein the air pipe comprises a partition section for partitioning the horizontal introduction section, the outlet section and the intermediate section.

9. The micro pressure wave reduction structure for a tunnel of claim 1, further comprising a cap section, which is capable of selectively closing the rear end of the outlet section.

* * * * *